US007540589B2

(12) United States Patent
Guan et al.

(10) Patent No.: US 7,540,589 B2
(45) Date of Patent: Jun. 2, 2009

(54) INTEGRATED CHARGE AND ORIFICE PLATES FOR CONTINUOUS INK JET PRINTERS

(75) Inventors: Shan Guan, Dublin, OH (US); Michael F. Baumer, Dayton, OH (US); Richard W. Sexton, Bainbridge, OH (US); James E. Harrison, Jr., Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 513 days.

(21) Appl. No.: 11/382,759

(22) Filed: May 11, 2006

(65) Prior Publication Data

US 2007/0263033 A1 Nov. 15, 2007

(51) Int. Cl.
*B41J 2/14* (2006.01)
*B41J 2/16* (2006.01)

(52) U.S. Cl. ..... 347/47; 347/76; 347/77

(58) Field of Classification Search ..... 347/40, 347/47, 76, 77
See application file for complete search history.

(56) References Cited

U.S. PATENT DOCUMENTS

| | | | |
|---|---|---|---|
| 3,984,843 | A | 10/1976 | Kuhn |
| 4,047,184 | A | 9/1977 | Bassous et al. |
| 4,106,975 | A | 8/1978 | Berkenblit et al. |
| 4,184,925 | A | 1/1980 | Kenworthy |
| 4,213,238 | A | 7/1980 | Gudorf |
| 4,223,320 | A | 9/1980 | Paranjpe et al. |
| 4,271,589 | A | 6/1981 | Gudorf |
| 4,277,548 | A | 7/1981 | Vedder |
| 4,334,232 | A | 6/1982 | Head |
| 4,347,522 | A | 8/1982 | Bahl et al. |
| 4,373,707 | A | 2/1983 | Molders |
| 4,374,707 | A | 2/1983 | Pollack |

(Continued)

FOREIGN PATENT DOCUMENTS

| | | |
|---|---|---|
| EP | 0 938 079 | 8/1999 |

(Continued)

OTHER PUBLICATIONS

T. Diepold et al., A Micromachined Continuous Ink Jet Print Head for High-Resolution Printing, J. Micromech. Microeng. 8, 1998, pp. 144-147.

(Continued)

*Primary Examiner*—Thinh H Nguyen
(74) *Attorney, Agent, or Firm*—William R. Zimmerli

(57) ABSTRACT

An integrated orifice array plate and a charge plate are fabricated for a continuous ink jet print head by producing an orifice plate and a charge plate, and by bonding the two together. The orifice plate is produced by providing an electrically non-conductive orifice plate substrate, forming a recessed-surface trench of predetermined depth into one of two opposed sides of the orifice plate substrate, and forming an array of orifices through the orifice plate substrate from the recessed surface of the trench to the other of the two opposed sides wherein the orifices are spaced apart by a predetermined distance. The charge plate is produced by providing an electrically non-conductive orifice plate substrate of predetermined thickness, and forming a plurality of charging leads on one of two opposed sides of the orifice plate substrate. The charge leads are spaced apart by said predetermined distance.

11 Claims, 10 Drawing Sheets

U.S. PATENT DOCUMENTS

| | | | |
|---|---|---|---|
| 4,378,631 | A | 4/1983 | Head et al. |
| 4,560,991 | A | 12/1985 | Schutrum |
| 4,636,808 | A | 1/1987 | Herron |
| 4,678,680 | A | 7/1987 | Abowitz |
| 4,894,664 | A | 1/1990 | Pan |
| 4,928,113 | A | 5/1990 | Howell et al. |
| 4,972,201 | A | 11/1990 | Katerberg et al. |
| 4,972,204 | A | 11/1990 | Sexton |
| 4,999,647 | A | 3/1991 | Wood et al. |
| 5,455,611 | A | 10/1995 | Simon et al. |
| 5,475,409 | A | 12/1995 | Simon et al. |
| 5,512,117 | A | 4/1996 | Morris |
| 5,559,539 | A | 9/1996 | Vo et al. |
| 5,604,521 | A | 2/1997 | Merkel et al. |
| 5,820,770 | A | 10/1998 | Cohen et al. |
| 6,164,759 | A | 12/2000 | Fujii et al. |
| 6,375,310 | B1 | 4/2002 | Arakawa et al. |
| 6,431,682 | B1 | 8/2002 | Osada et al. |
| 6,464,892 | B2 | 10/2002 | Moon et al. |
| 6,545,406 | B2 | 4/2003 | Hofmann et al. |
| 6,560,991 | B1 | 5/2003 | Kotliar |
| 6,627,096 | B2 | 9/2003 | Sherrer et al. |
| 6,635,184 | B1 | 10/2003 | Cohen et al. |
| 6,660,614 | B2 | 12/2003 | Hirschfeld et al. |
| 6,759,309 | B2 | 7/2004 | Gross |
| 7,237,877 | B2 * | 7/2007 | Sato et al. ..... 347/68 |
| 2002/0000516 | A1 | 1/2002 | Schultz et al. |
| 2002/0000517 | A1 | 1/2002 | Corso et al. |
| 2002/0063107 | A1 | 5/2002 | Moon et al. |
| 2003/0022397 | A1 | 1/2003 | Hess et al. |
| 2003/0054645 | A1 | 3/2003 | Sheldon |
| 2003/0066816 | A1 | 4/2003 | Schultz et al. |
| 2003/0073260 | A1 | 4/2003 | Corso |

FOREIGN PATENT DOCUMENTS

| | | |
|---|---|---|
| EP | 1 020 291 | 1/2000 |
| FR | 2 698 584 | 11/1992 |

OTHER PUBLICATIONS

J. Smith et al., Continuous Ink-Jet Print Head Utilizing Silicon Micromachined Nozzles, Sensors and Actuators A, 43, 1994, pp. 311-316.

Rhonda Renee Myers, Novel Devices for Continuous-on-Demand Ink Jet Deflection Technologies, B.S.E.E., University of Cincinnati, Nov. 17, 2005.

* cited by examiner

INTEGRATED CHARGE AND ORIFICE PLATES FOR CONTINUOUS INK JET PRINTERS

CROSS REFERENCE TO RELATED APPLICATIONS

Reference is made to commonly assigned, U.S. Pat. No. 7,437,820 and U.S. Patent Publication Nos.2007/0261239 and 2007/0263042.

FIELD OF THE INVENTION

The present invention relates to continuous ink jet printers, and more specifically to the fabrication of MEMS-bases integrated orifice plate and charge plate for such using electroforming and anodic bonding and silicon etching techniques.

BACKGROUND OF THE INVENTION

Continuous-type ink jet printing systems create printed matter by selective charging, deflecting and catching drops produced by one or more rows of continuously flowing ink jets. The jets themselves are produced by forcing ink under pressure through an array of orifices in an orifice plate. The jets are stimulated to break up into a stream of uniformly sized and regularly spaced droplets.

The approach for printing with these droplet streams is to use a charge plate to selectively charge certain drops, and to then deflect the charged drops from their normal trajectories. The charge plate has a series of charging electrodes located equidistantly along one or more straight lines. Electrical leads are connected to each such charge electrode, and the electrical leads in turn are activated selectively by an appropriate data processing system.

U.S. Pat. No. 4,636,808, which issued to Herron, describes a simple arrangement of the drop generator and the charge plate. U.S. Pat. No. 6,660,614 discloses anodic bonding, while U.S. Pat. No. 4,560,991 discloses a method of forming charge plates using electroforming. Both of these techniques are used in the practice of the preferred embodiment of the present invention.

Conventional and well-known processes for making the orifice plate and charge plate separately consist of photolithography and nickel electroforming. Orifice plate fabrication methods are disclosed in U.S. Pat. Nos. 4,374,707; 4,678,680; and 4,184,925. Orifice plate fabrication generally involves the deposition of a nonconductive thin disk followed by partial coverage of this with nickel to form an orifice. After formation of the orifice, the metal substrate is selectively etched away leaving the orifice plate electroform as a single component. Charge plate electroforming is described in U.S. Pat. Nos. 4,560,991 and 5,512,117. These charge plates are made by depositing nonconductive traces on a metal substrate followed by deposition of nickel in a similar fashion to orifice plate fabrication, except that parallel lines of metal are formed instead of orifices. Nickel, which is a ferromagnetic material, is unsuitable for use with magnetic inks. Nor can low pH ink (pH less than, say, 6) be used with nickel, which is etched by low pH ink.

Epoxy is generally used to bond the separately fabricated charge plate and orifice plate. Using epoxy in bonding is often called "adhesive bonding" and limits yield. Nor does epoxy bonding provide a very robust connection. It is very easy to introduce the trapped air between the two components, so it is normally not a void-free bonding technique. The anodic bonding is a relatively low temperature process (the temperature can be as low as 350° C.), but with a higher bonding strength, and is normally a void-free bonding.

Accordingly, it is an object of the present invention to provide a fabrication process of the orifice plate and charge plate that permits the use of both low pH and magnetic inks. It is another object of the present invention to provide such an orifice plate and charge plate as one, self-aligned component with high yield and robust connection.

SUMMARY OF THE INVENTION

According to a feature of the present invention, an integrated orifice array plate and a charge plate is fabricated for a continuous ink jet print head by producing an orifice plate and a charge plate, and by bonding the two together. The orifice plate is produced by providing an electrically non-conductive orifice plate substrate, forming a recessed-surface trench of predetermined depth into one of two opposed sides of the orifice plate substrate, and forming an array of orifices through the orifice plate substrate from the recessed surface of the trench to the other of the two opposed sides wherein the orifices are spaced apart by a predetermined distance. The charge plate is produced by providing an electrically non-conductive orifice plate substrate of predetermined thickness, and forming a plurality of charging leads on one of two opposed sides of the orifice plate substrate. The charge leads are spaced apart by said predetermined distance.

In a preferred embodiment of the present invention, the one of the two opposed sides of the orifice plate substrate is initially coated with a silicon nitride layer; and the orifices are formed by etching into the orifice plate substrate through openings in the silicon nitride layer on the one side of the orifice plate substrate. Preferably, the one of the two opposed sides of the orifice plate substrate is initially coated with a silicon nitride layer; and the trench is formed by etching into the orifice plate substrate through openings in the silicon nitride layer on the one side of the orifice plate substrate. The charging leads may be formed by coating the one of the two opposed sides of the charge plate substrate with a silicon nitride layer and then a conductive layer; electroforming charging leads on the conductive layer; and isolating the charging leads one from the others.

According to another feature of the present invention, the fabrication of the orifice plate further includes forming an ink channel the other side of the orifice plate substrate. Preferably, the ink channel is formed by coating the other side of the orifice plate substrate with a silicon nitride layer, and etching into the orifice plate substrate through an opening in the silicon nitride layer on the other side of the orifice plate substrate.

According to yet another feature of the present invention, a continuous ink jet printer print head includes an integral orifice array plate and charge plate. The charge plate has an electrically non-conductive orifice plate substrate, a trench of predetermined depth on one of two opposed sides of the orifice plate substrate, and an array of orifices through the orifice plate substrate from the trench to the other of the two opposed sides. The orifices are spaced apart by a predetermined distance. The a charge plate has an electrically non-conductive charge plate substrate of predetermined thickness, and a plurality of charging leads on one of two opposed sides of the charge plate substrate. The charge leads are spaced apart by the predetermined distance, wherein the other of the two opposed sides of the charge plate is bonded to the one side of the orifice plate substrate such that the charging leads align respectively with the orifices of the array and are spaced there from by the depth of the trench and the thickness of the orifice plate substrate.

Anodic bonding techniques are used to avoid using epoxy for component bonding, thus producing high yield and robust connections from a relatively low temperature process (the temperature can be as low as 350° C.), but with a high bonding strength, that is normally void-free.

DETAILED DESCRIPTION OF THE INVENTION

It will be understood that the orifice array plate and the charge plate of the present invention are intended to cooperate with otherwise conventional components of ink jet printers that function to produce desired streams of uniformly sized and spaced drops in a highly synchronous condition. Other continuous ink jet printer components, e.g. drop ejection devices, deflection electrodes, drop catcher, media feed system and data input and machine control electronics (not shown) cooperate to effect continuous ink jet printing. Such devices may be constructed to provide synchronous drop streams in a long array printer, and comprise in general a resonator/manifold body, a plurality of piezoelectric transducer strips, an orifice plate and transducer energizing circuitry.

Figure 1:
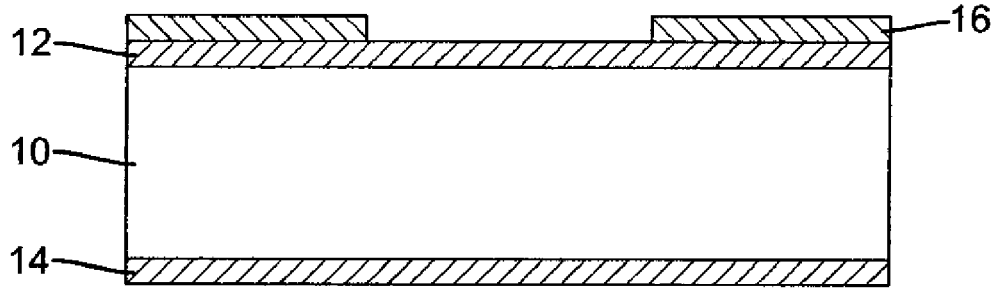
FIG. 1 is a cross-sectional view of a silicon substrate, silicon nitride layer, and patterned photo resist layer usable in the present invention.

FIG. 1 shows a silicon substrate 10 coated on both sides with thin layers 12 and 14 of silicon nitride. In the preferred embodiment, dipping in buffed hydrofluoric acid chemically cleans the substrate, and the silicon nitride layers are applied such as by low-pressure chemical vapor deposition. A photoresist 16 has been applied; such as by spin coating, to one side of the composite 10, 12, and 14. The photoresist has been imagewise exposed through a mask (not shown) and developed to leave a pattern for forming an ink channel as detailed below. Positive photoresist is preferred.

Figure 2:
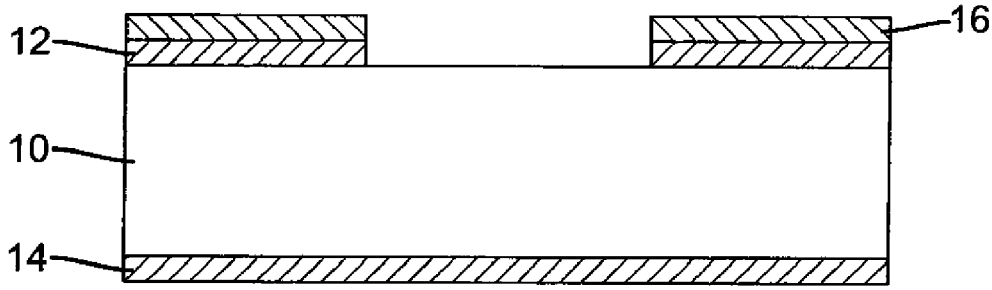
FIGS. 2 and 3 are cross-sectional views of initial steps in a process for fabricating an orifice plate of FIG. 10 from the silicon substrate of FIG. 1.
Figure 3:
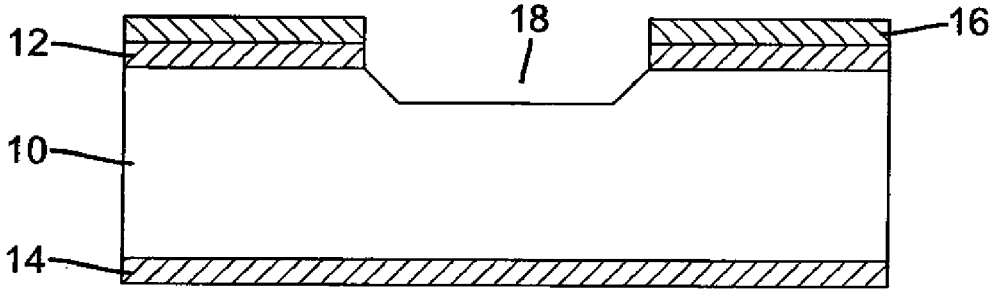
Figure 4:
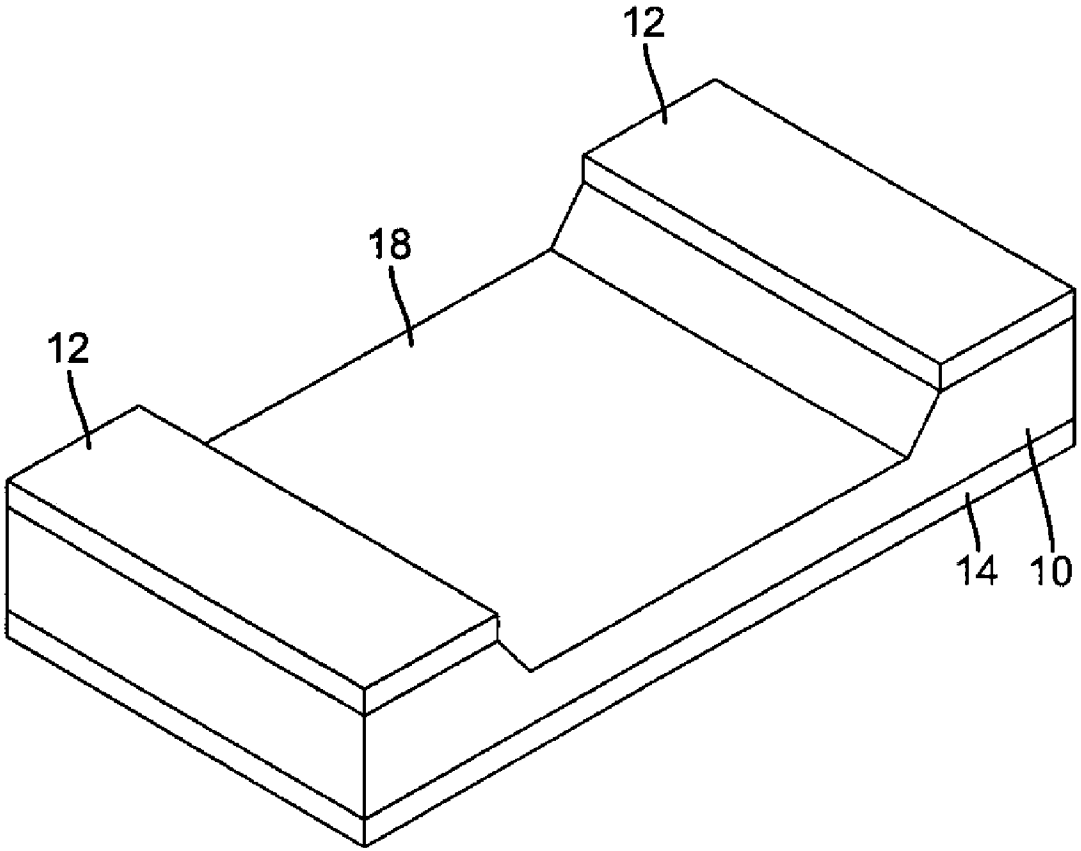
FIG. 4 is a perspective view of the orifice plate at this point in the fabrication process.

Referring to FIG. 2, silicon nitride layer 12 has been etched away according to the photoresist pattern. In FIG. 3, an ink channel 18 has been etched into silicon substrate 10 such as by means of a potassium hydroxide solution heated between 60° C. and 90° C. Silicon nitride layer 12 acts as an etching mask. In the preferred embodiment, ink channel 18 is between 50 μm and 150 μm. Photoresist 16 is stripped using, say, acetone, and the wafer surface is cleaned such as by the use of $O_2$ plasma. FIG. 4 is a perspective view of the orifice plate at this point in the fabrication process.

Figure 5:
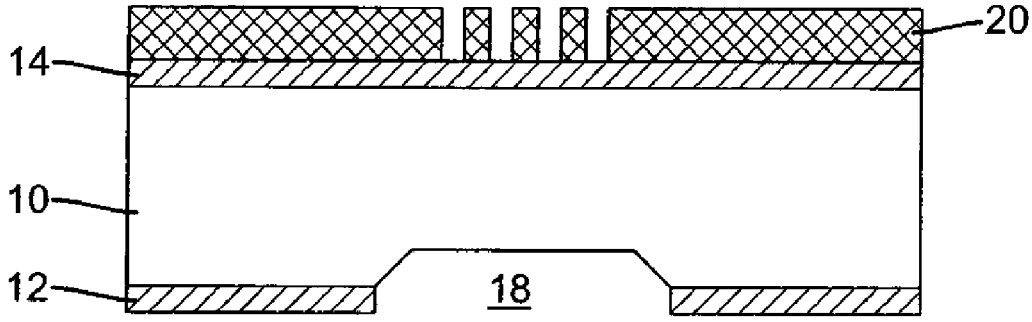
FIGS. 5-9 are cross-sectional views of steps in a process for fabricating an orifice plate of FIG. 10 from the silicon substrate of FIG. 1.

Next, a positive tone photoresist 20 is spun onto silicon nitride layer 14 on the opposite side of the composite 10, 12, and 14, and is patterned by, say, photolithography. FIG. 5 illustrates the result, but is greatly simplified for clarity. For example, only four patterned indentations are shown, but it will be understood that, in practice, the number of indentations will equal the number of nozzles desired.

Figure 6:
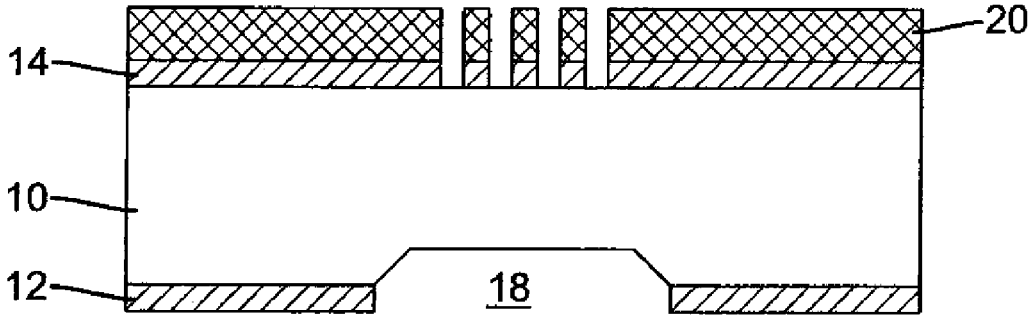
Figure 7:
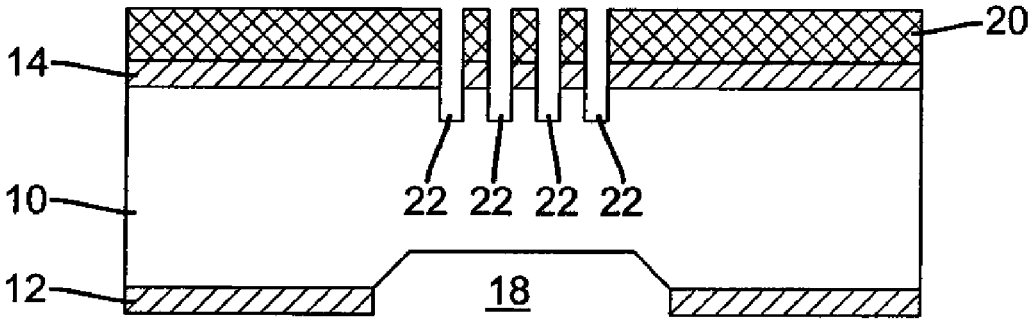

The silicon nitride exposed through the pattern in photoresist 20 is etched away by, for example, reactive ion etching. The result is shown in FIG. 6. A series of nozzle openings 22 are etched into silicon substrate 10 using, say, deep reactive ion etching, which is a form of reactive ion etching especially suited to etch a deep profile with relatively straight sidewalls. The depths of nozzle openings 22 are controlled by the etching time. FIG. 7 shows the result of these steps.

Figure 8:
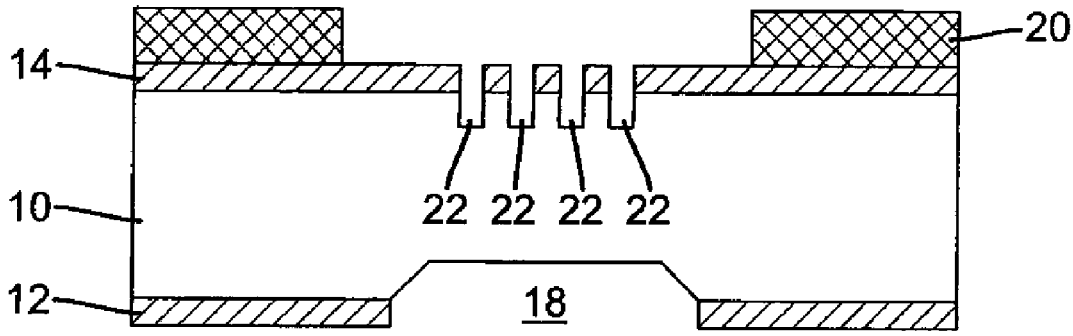
Figure 9:
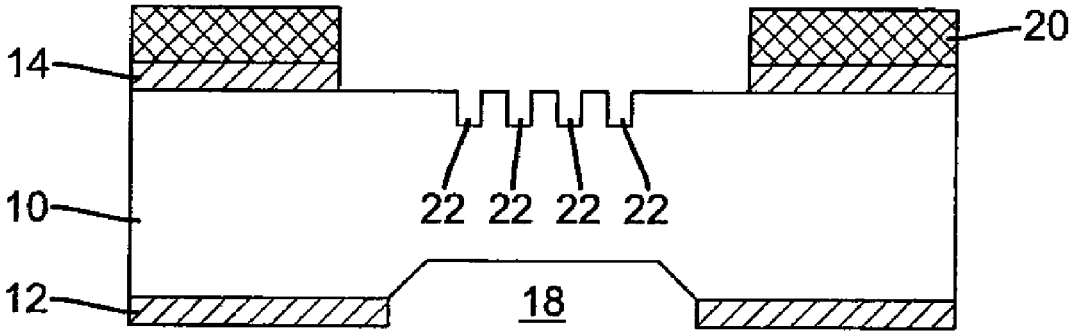
Figure 10:
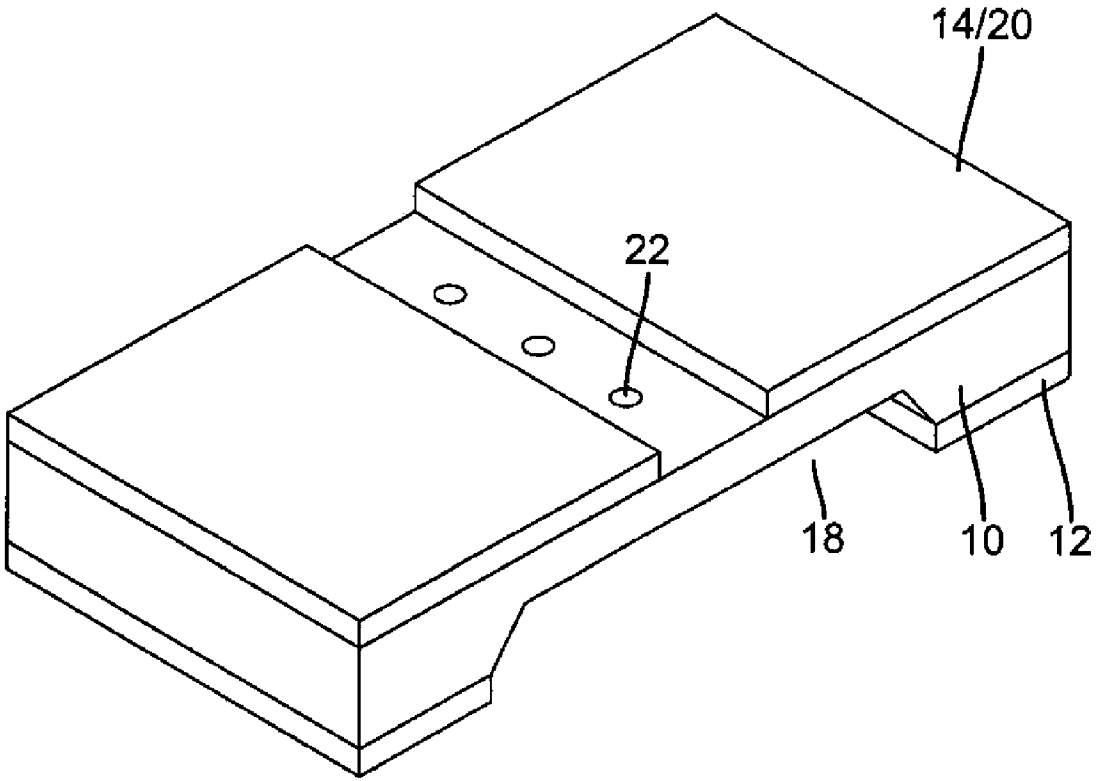
FIG. 10 is a perspective view of the orifice plate at this point in the fabrication process.

Another photolithography step re-patterns photoresist 20 as in FIG. 8 so that the exposed silicon nitride can be removed using reactive ion etching as shown in FIG. 9 (and as shown in perspective in FIG. 10).

Figure 11:
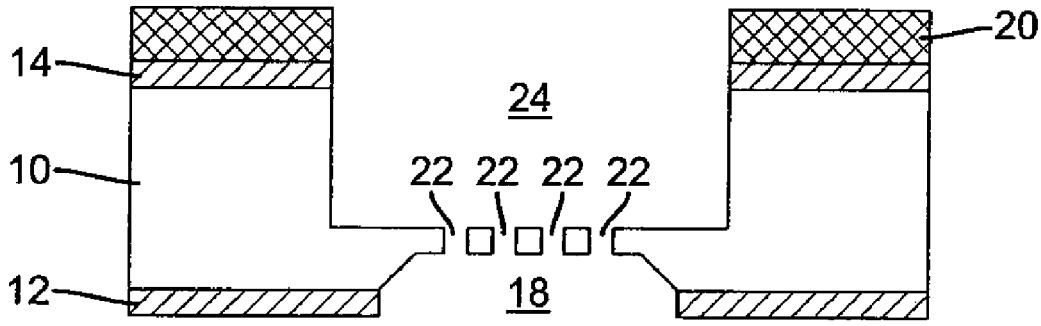
FIGS. 11 and 12 are cross-sectional views of final steps in a process for fabricating an orifice plate of FIG. 10 from the silicon substrate of FIG. 1.
Figure 12:
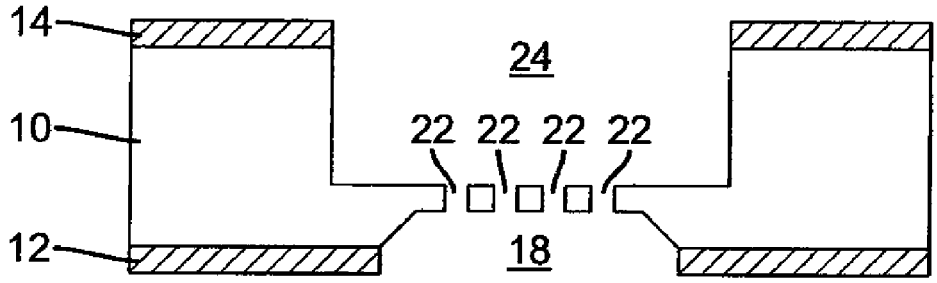
Figure 13:
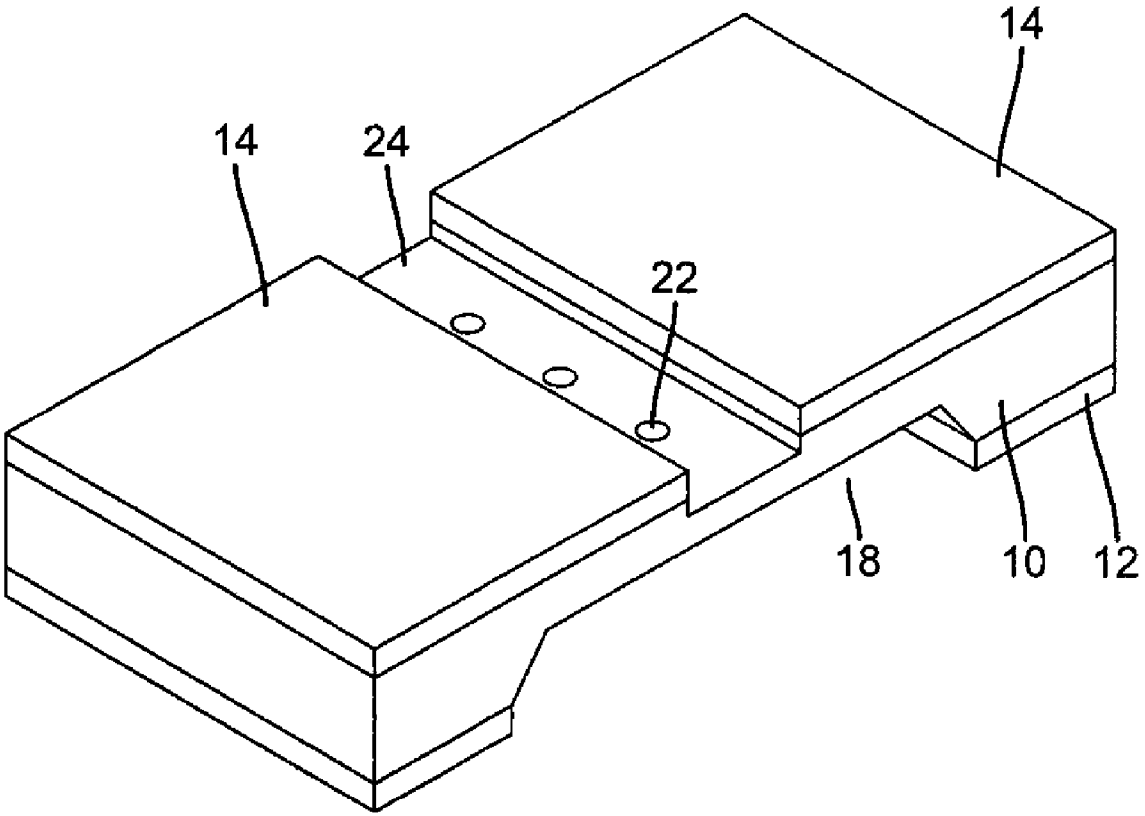
FIG. 13 is a perspective view of the finished orifice plate.

Referring to FIG. 11, nozzle openings 22 and a trench 24 are simultaneously deep reactive ion etched. Ink channel 18 acts as an etching stop when the nozzle openings break through silicon substrate 10 because the helium flow rate in the deep reactive ion etching process changes to stop the etching process. Photoresist 20 is striped and the wafer cleaned to produce a finished orifice plate 26 as illustrated in FIG. 12, and the result is shown in perspective view 13.

Figure 14:
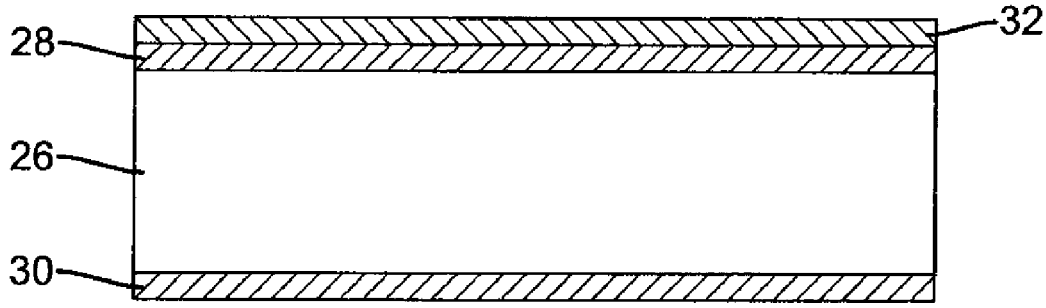
FIGS. 14-17 are cross-sectional views of steps in a process for fabricating of charge plate according to the present invention.

FIG. 14 shows a second silicon substrate 26 that also has been coated on both sides with thin layers 28 and 30 of silicon nitride by low pressure chemical vapor deposition or other suitable process known in the art. A conductive layer 32 of Au (gold), Cu (copper) or Ni (nickel) is applied to one side of the wafer using a sputtered adhesive layer of, say, chromium or titanium. The thickness of substrate 26 can be selected to meet desired droplet break-off lengths. A thicker charge plate corresponds to a longer drop break-off length. Thicknesses from 200 μm to 1500 μm are contemplated.

Figure 15:
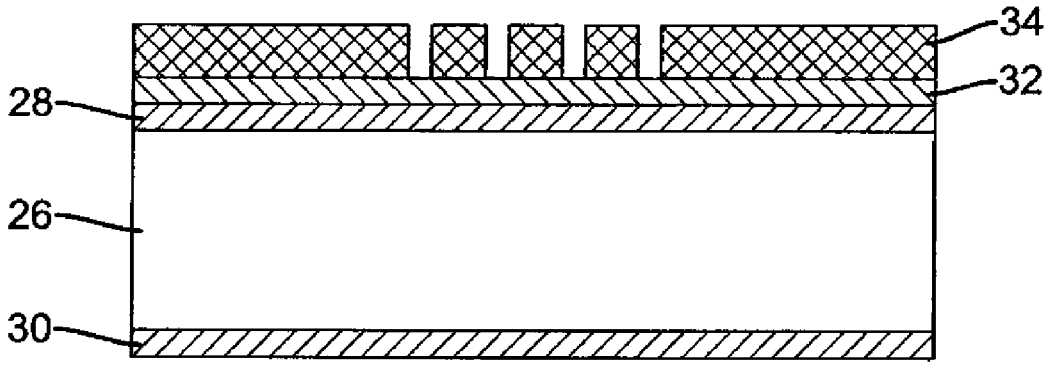
Figure 16:
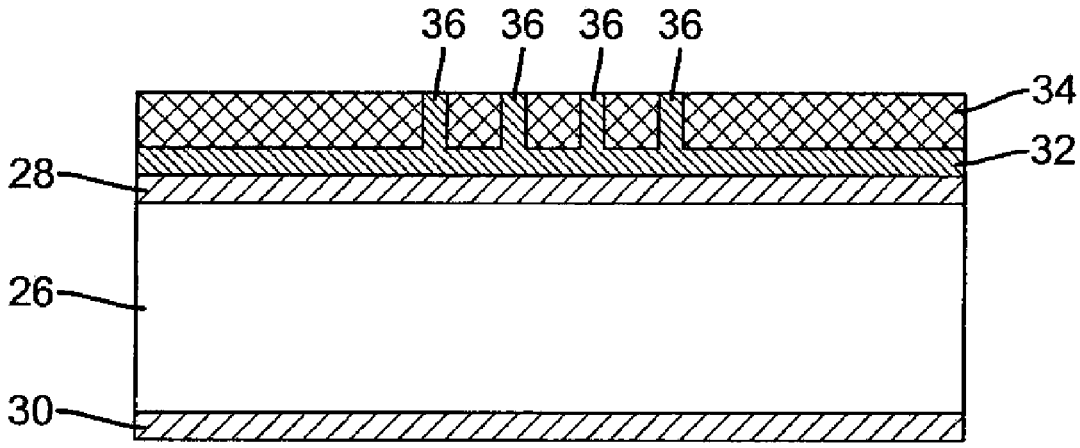
Figure 17:
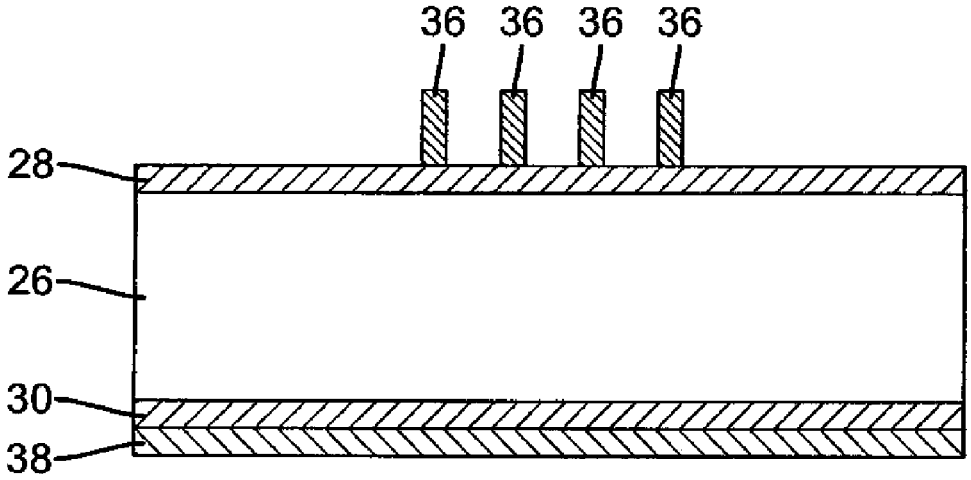
Figure 18:
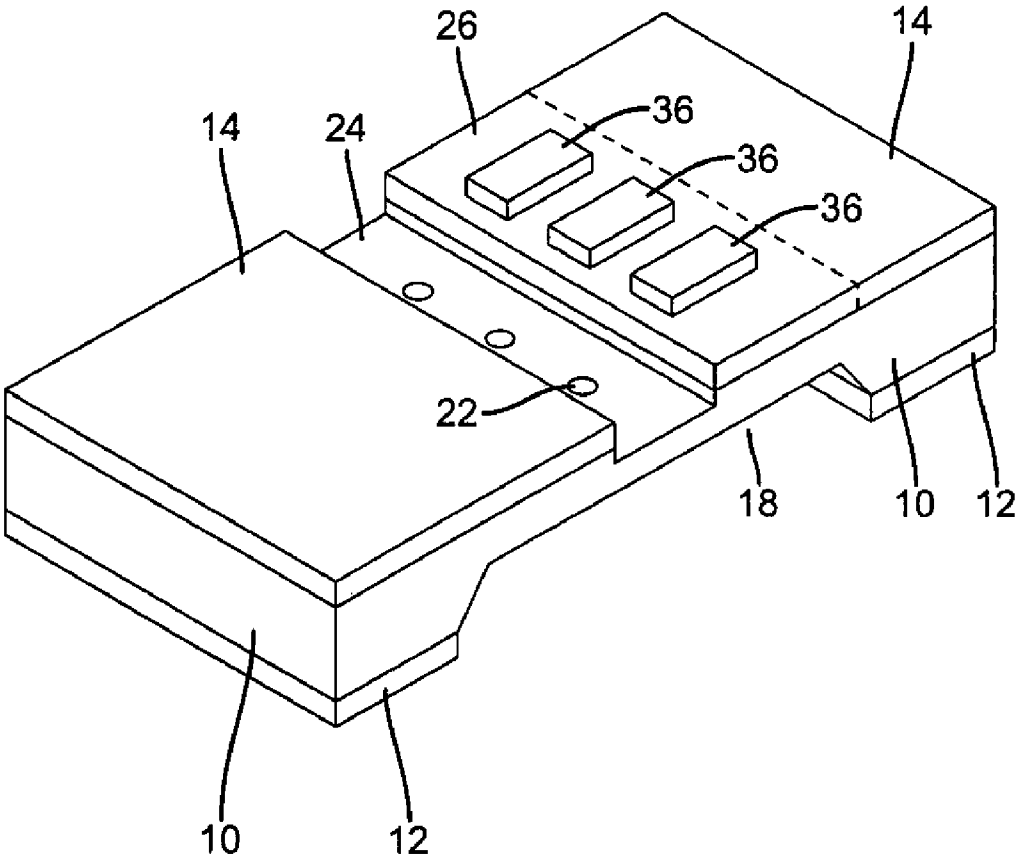
FIG. 18 is a perspective view of the bonded charge plate and orifice plate according to the present invention.

In FIG. 15, a thick (at least 100 μm) photosensitive film 34 of photoresist is patterned so that charging leads 36 can be electroformed. Preferably, through mask electroplating is used as illustrated in FIG. 16. When the photosensitive film 34 is stripped (such as by acetone) and the surface $O_2$ plasma cleaned, conductive layer 32 is etched away using ion milling technique to leave charging leads 36 as shown in FIG. 17. The charging electrodes leads will also have been etched, but not enough to be of concern. A layer 38 of silicon oxide ($SiO_2$) is deposited on the backside of the silicon substrate 26 (the side of the wafer without the charging leads) to form an anodic bonding layer. After this step, the fabrication of the charge plate is complete. The final step is to bond the charge plate to the orifice plate as shown in FIG. 18. Anodical bonding is also known as "Field-assisted thermal bonding." It is commonly used to join silicon to glass (or silicon coated with silicon oxide). Anodic bonding is a relatively low temperature process (the temperature can be as low as 350° C.), but with a higher bonding strength, and is normally void-free.

The invention has been described in detail with particular reference to certain preferred embodiments thereof, but it will be understood that variations and modifications can be effected within the spirit and scope of the invention.

| PARTS LIST | |
|---|---|
| 10. | silicon substrate |
| 12. | silicon nitride layer |
| 14. | silicon nitride layer |
| 16. | photoresist |
| 18. | ink channel |
| 20. | photoresist |
| 22. | nozzle openings |
| 24. | trench |
| 26. | silicon substrate |
| 28. | silicon nitride layer |
| 30. | silicon nitride layer |
| 32. | conductive layer |
| 34. | photosensitive film |
| 36. | charging leads |

The invention claimed is:

1. A method for integrally fabricating an orifice array plate and a charge plate for a continuous ink jet printer print head, said method comprising the steps of:

a. producing an orifice plate by:

providing an electrically non-conductive orifice plate substrate, forming a recessed-surface trench of predetermined depth into one of two opposed sides of the orifice plate substrate, and forming an array of orifices through the orifice plate substrate from the recessed surface of the trench to the other of the two opposed sides wherein said orifices are spaced apart by a predetermined distance;

b. producing a charge plate by:

providing an electrically non-conductive charge plate substrate of predetermined thickness, and forming a plurality of charging leads on one of two opposed sides of the charge plate substrate, said charge leads being spaced apart by said predetermined distance; and c. bonding the other of the two opposed sides of the charge plate substrate to said one side of the orifice plate substrate such that the charging leads align respectively with the orifices of the array and are spaced there from by the depth of the trench and the thickness of the orifice plate substrate.

2. A method for integrally fabricating an orifice array plate and a charge plate as set forth in claim 1, wherein:

the one of the two opposed sides of the orifice plate substrate is initially coated with a silicon nitride layer; and the orifices are formed by etching into the orifice plate substrate through openings in the silicon nitride layer on the one side of the orifice plate substrate.

3. A method for integrally fabricating an orifice array plate and a charge plate as set forth in claim 1, wherein:

the one of the two opposed sides of the orifice plate substrate is initially coated with a silicon nitride layer; and the trench is formed by etching into the orifice plate substrate through openings in the silicon nitride layer on the one side of the orifice plate substrate.

4. A method for integrally fabricating an orifice array plate and a charge plate as set forth in claim 1, wherein:

the one of the two opposed sides of the orifice plate substrate is initially coated with a silicon nitride layer;

the orifices are formed by etching into the orifice plate substrate through openings in the silicon nitride layer on the one side of the orifice plate substrate; and the trench is formed by etching into the orifice plate substrate through openings in the silicon nitride layer on the one side of the orifice plate substrate.

5. A method for integrally fabricating an orifice array plate and a charge plate as set forth in claim 1, wherein the charging leads are formed by:

coating the one of the two opposed sides of the charge plate substrate with a silicon nitride layer and then a conductive layer;

electroforming charging leads on the conductive layer; and isolating the charging leads one from the others.

6. A method for integrally fabricating an orifice array plate and a charge plate as set forth in claim 1, wherein the thickness of the charge plate substrate is selected to meet desired droplet break-off lengths.

7. The method of claim 1 wherein the step of forming an orifice plate further comprises the step of forming an ink channel the other side of the orifice plate substrate.

8. A method for integrally fabricating an orifice array plate and a charge plate as set forth in claim 7, wherein the ink channel is formed by:

coating the other side of the orifice plate substrate with a silicon nitride layer; and etching into the orifice plate substrate through an opening in the silicon nitride layer on the other side of the orifice plate substrate.

9. An integral orifice array plate and charge plate for a continuous ink jet printer print head, comprising:

a. an orifice plate having:

an electrically non-conductive orifice plate substrate, a trench of predetermined depth on one of two opposed sides of the orifice plate substrate, and an array of orifices through the orifice plate substrate from the trench to the other of the two opposed sides, said orifices being spaced apart by a predetermined distance; and b. a charge plate having:

an electrically non-conductive charge plate substrate of predetermined thickness, and a plurality of charging leads on one of two opposed sides of the charge plate substrate, said charge leads being spaced apart by said predetermined distance, wherein the other of the two opposed sides of the charge plate is anodically bonded to said one side of the orifice plate substrate such that the charging leads align respectively with the orifices of the array and are spaced there from by the depth of the trench and the thickness of the orifice plate substrate.

10. An integral orifice array plate and charge plate as set forth in claim 9 wherein the orifice plate further comprises an ink channel the other side of the orifice plate substrate.

11. An integral orifice array plate and charge plate as set forth in claim 9 wherein the thickness of the charge plate substrate is selected to meet desired droplet break-off lengths.

* * * * *